United States Patent [19]

Bishop

[11] 4,448,235

[45] May 15, 1984

[54] VARIABLE-PERMEABILITY, TWO-LAYER PATTERN COATING FOR LOST FOAM CASTING

[75] Inventor: Gary E. Bishop, Romeo, Mich.

[73] Assignee: General Motors Corporation, Detroit, Mich.

[21] Appl. No.: 402,108

[22] Filed: Jul. 26, 1982

[51] Int. Cl.[3] ..... B22C 9/02; B22C 7/00

[52] U.S. Cl. ..... 164/34; 164/45; 164/249

[58] Field of Search ..... 164/34, 45, 249

[56] References Cited

U.S. PATENT DOCUMENTS

| | | | |
|---|---|---|---|
| 3,410,942 | 11/1968 | Bayer | 164/34 X |
| 3,498,360 | 3/1970 | Wittmoser et al. | 164/34 X |
| 4,010,791 | 3/1977 | Hetke et al. | 164/34 |

*Primary Examiner*—Gus T. Hampilos
*Assistant Examiner*—Jerold L. Johnson
*Attorney, Agent, or Firm*—Douglas D. Fekete

[57] ABSTRACT

A vaporizable pattern for casting reduced porosity metal by a lost foam process is coated first with a thermally insulative, refractory layer characterized by a relatively high gas permeability and thereafter with a vaporizable polymeric layer characterized by a relatively low gas permeability. During metal casting, the refractory layer insulates the polymeric layer to delay vaporization, whereupon the low permeability causes pattern decomposition vapors to build up and slow metal replacement of the pattern to reduce vapor-entrapping turbulence. After vaporization of the polymeric layer, the vapors readily vent through the high permeability, refractory layer to avoid entrapment in the metal.

6 Claims, 4 Drawing Figures

VARIABLE-PERMEABILITY, TWO-LAYER PATTERN COATING FOR LOST FOAM CASTING

BACKGROUND OF THE INVENTION

This invention relates to a coating applied to a polystyrene pattern for casting metal by a lost foam process. More particularly, this invention relates to a dual coating that initially has a low permeability to pattern decomposition vapors, but thereafter develops a high permeability, which variable permeability reduces turbulence in metal replacing the pattern, while ultimately exhausting substantially all vapors, to reduce gas entrapment in the metal that would form porosity in the casting.

In casting by a lost foam process, molten metal is poured into a polystyrene pattern embedded in a sand mold. The metal vaporizes the polystyrene and flows into the resulting void, thereby concurrently consuming and replacing the pattern to form a casting. A coating is preferably applied to the pattern prior to casting to thermally insulate the metal to prevent freezing before the entire pattern is replaced. The coating may also keep the mold from collapsing prior to being filled, particularly when casting relatively high melting metals, such as iron, that consume the pattern substantially in advance of the melt.

During casting, pattern decomposition vapors escape through the coating into the sand mold. Vapors that cannot escape collect in pockets in the metal that form undesirable pores in the casting. Thus, a coating having a high permeability is desired to exhaust substantially all vapors. Pores also form as a result of turbulence in the melt that entrap vapors. Severe turbulence may even entrap polystyrene before vaporization, whereupon even a small piece may produce a relatively large pore. The severity of turbulence is related to the rate at which metal fills the mold, faster filling producing generally greater turbulence. It has been found that vapor buildup in advance of the metal slows the flow and thus reduces turbulence. Suitable vapor buildup is produced by a coating having a low permeability. Thus, both low and high vapor permeability through the coating reduces porosity in the casting.

Therefore, it is an object of this invention to provide an improved thermally insulative coating applied to a vaporizable pattern for lost foam casting of metal, which coating is adapted to have initially a relatively low vapor permeability to cause pattern decomposition vapors to build up and slow melt flow to replace the pattern, thereby reducing vapor-entrapping turbulence in the melt. After a suitable delay, the coating develops a high vapor permeability to allow substantially all vapors to escape from becoming entrapped in the melt. Thus, the coating sequentially exhibits both low and high vapor permeability during casting at suitable times for reducing porosity in the product casting.

BRIEF SUMMARY OF THE INVENTION

In a preferred embodiment, a vaporizable polystyrene pattern for lost foam casting is coated with a first refractory layer characterized by relatively high gas permeability and an overlying polymeric layer characterized by relatively low gas permeability. The refractory layer forms a thermally insulative barrier about the pattern suitable for preventing premature melt solidification. The polymeric material of the overlayer is vaporizable at metal casting temperatures. Because of the low permeability of the overlayer, permeability through the two-layer coating is similarly low.

During casting, the coated pattern is embedded in a lake sand mold and molten metal is poured into the mold such that a melt front progressively consumes the pattern, vaporizing the polystyrene. The refractory layer not only insulates the melt front to prevent premature solidification, but also insulates the polymeric overlayer to delay its vaporization. Thus, the low-permeability polymeric layer remains for a sufficient time to cause pattern decomposition vapors to build up ahead of the melt front. This buildup slows the melt front and reduces turbulence. However, eventually sufficient heat is conducted through the refractory layer to vaporize the polymeric layer. This leaves only the high permeability refractory layer, through which vapors readily escape into the mold. Thus, the two layers of the coating cooperate to produce a desired sequence of low and high permeability that not only reduces gas-entrapping turbulence in the melt front, but also vents substantially all vapors, thus mitigating both principal causes of porosity in the product casting.

DETAILED DESCRIPTION OF THE INVENTION

Figure 1:
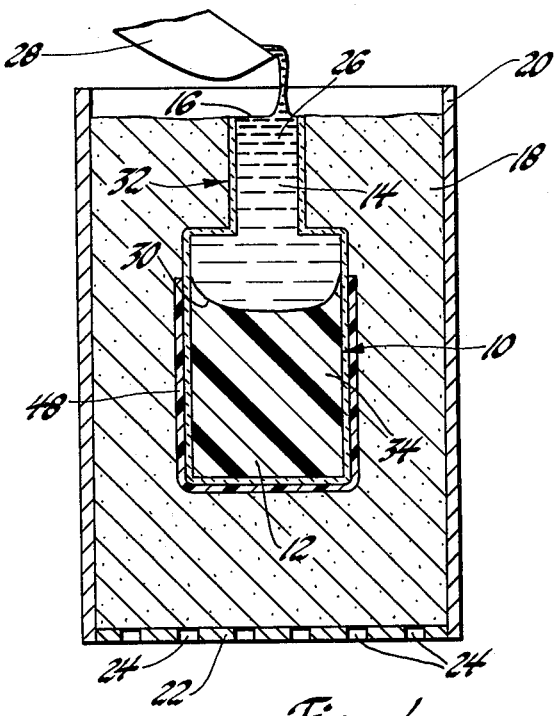
FIG. 1 is a cross sectional view showing a lost foam casting pattern bearing a two-layer coating in accordance with this invention, in the process of being consumed during casting.

Referring to FIG. 1, in a preferred embodiment, a dual coated, low density polystyrene pattern 10 is provided for forming an aluminum alloy casting. Pattern 10 comprises a product portion 12 suitably sized and shaped to produce a desired product casting. Pattern 10 also comprises a downsprue portion 14 having an uncoated surface 16 and communicating with product portion 12 for admitting and conveying melt to replace the product portion 12. The pattern is formed by injecting preexpanded polystyrene beads into a cavity defined within a steam chest and forcing steam therethrough to fuse the beads into the pattern.

For casting, pattern 10 is embedded in a mold 18 formed of dry, unbonded sand, such as lake sand. Mold 18 is contained in a flask 20 comprising a bottom wall 22 having perforations 24 through which air is injected to fluidize mold 18 for embedding pattern 10 and removing the product casting. Pattern 10 is embedded in mold 18 such that product portion 12 is fully submerged and metal-admitting surface 16 lies above mold 18.

During casting, molten aluminum alloy 26 is poured from a ladle 28 onto pattern surface 16. Heat from metal 26 vaporizes adjacent polystyrene, whereupon metal flows into the space vacated by the vaporized polystyrene, thereby exposing the metal to additional polystyrene for vaporization. Thus, melt 26 progressively destroys pattern 10 and concurrently duplicates its shape to form the casting. This progressive vaporization and flow occurs along a melt front 30. Front 30 travels along downsprue 14 and thereafter through product portion 12.

In accordance with this invention, pattern 10 is doubly coated prior to casting. A first coat 32 is formed of a refractory, thermally insulative material. The refractory material comprises, by weight, about 61 parts silicon dioxide (silica), 2 parts attapulgite clay, 5.5 parts bentonite clay, 4 parts muskovite (mica), 15.5 parts kaolin clay, 0.5 parts zanthan gum and 4 parts calcium lignosulfonate binder. The preferred coating is prepared from a water-containing core wash coating material commercially available from C. E. Cast Products, Ohio, under the trade designation Arcoate 108. To 100 parts by weight cake is added about 13 parts kaolin clay and sufficient water to form a slurry having a specific gravity of 35° Baumé. The pattern is dipped into the slurry, excess slurry is drained off, and the residual is hot air dried at 43° C. to form the coat. The coating weight is about 0.084 grams per square centimeter. The coating is very thin, typically being on the order of about 50 microns thick.

Figure 2:
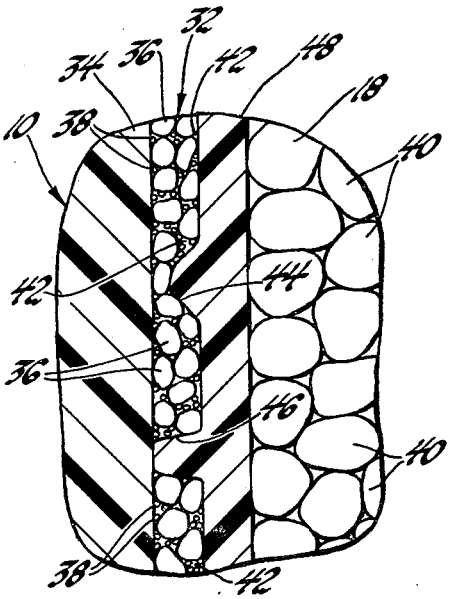
FIG. 2 is an enlarged cross-sectional view of a portion of the pattern in FIG. 1 showing the two-layer coating prior to casting.
Figure 3:
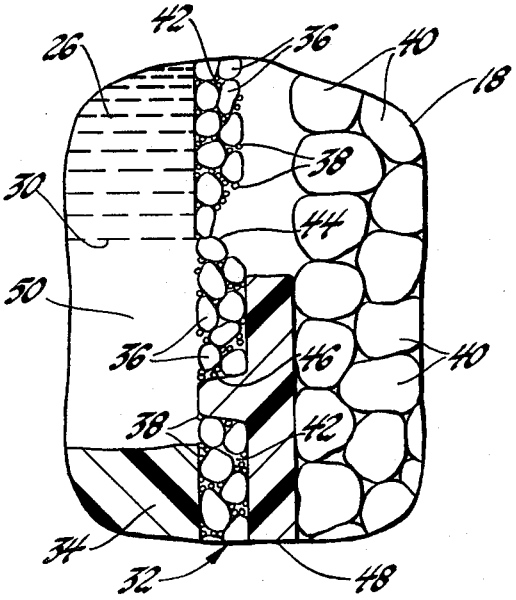
FIG. 3 is an enlarged view similar to FIG. 2 showing the coating during casting as the adjacent pattern is being vaporized and replaced by melt.
Figure 4:
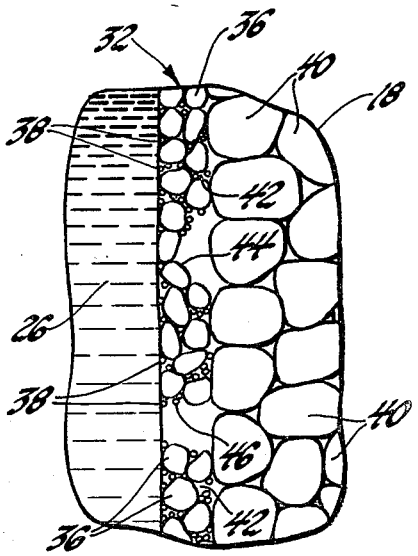
FIG. 4 is an enlarged view similar to FIGS. 2 and 3 and showing the coating adjacent the metal after casting.

The nature of the refractory coat 32 is better understood by reference to FIGS. 2 through 4, which figures are intended for illustration and not as accurate depictions. Coat 32 is applied onto a polystyrene base 34 that forms the basis of pattern 10. The coat is formed of a particulate refractory matrix comprising relatively large, irregularly shaped particles 36, believed to be principally silica, and relatively fine, irregularly shaped particles 38, believed to be principally kaolin, bonded together, principally by the lignosulfonate compound. Even the relatively large particles 36 are substantially smaller than sand particles 40 that form mold 18, the ratio of maximum cross-sectional dimensions being about 1 to 2.5. In comparison, silica particles 36 are about 100 times larger in cross-sectional dimension than kaolin particles 38. Particles 38 pack between particles 36 so that coat 32 is relatively dense. This dense refractory reduces heat flow from the metal into the mold, thereby permitting lower metal pouring temperatures to consume the entire pattern.

In addition, coat 32 includes a network of interstitial pores 42 interconnected so as to form gas passages through the coat. Gas flow through coat 32 occurs more readily at thin regions 44, and is essentially unhindered at cracks 46, that form during drying. Thus, despite the relatively dense packing of refractory particles, coat 32 has a relatively high gas permeability.

A second coat 48 is applied over refractory coat 32. Overcoat 48 is composed of an acrylic polymer that is vaporizable at molten aluminum temperatures. To apply coat 48, the refractory-coated pattern is dipped into an aqueous emulsion containing the polymer. A preferred acrylic polymer is commercially available from the Rohm and Haas Co., Philadelphia, Pa. under the trade designation Rhoplex AC 33. One part commercial product was diluted with approximately 4 parts water to form a suitable bath for dipping. Some intermixing of the coating materials occur, but it is believed that coat 32 remains for the most part intact. Excess emulsion is drained off and the residue is hot air dried. The coating weight is preferably about 0.0043 gram per square centimeter, corresponding to a thickness of about 20 microns.

In contrast to particulate coat 32, acrylic overcoat 48 is relatively dense and nonporous. Furthermore, the acrylic emulsion flows and fills thin areas 44 and cracks 46 in refractory coat 32. Overcoat 48 does improve thermal insulation over coat 32 alone. However, more significantly, overcoat 48 reduces gas permeability through the combined coats. Thus, gas permeability through both coats 32 and 48 is estimated to be approximately one-fifth that through refractory coat 32 alone.

The lost foam casting process is illustrated in FIG. 3. Heat from melt front 30 vaporizes the polystyrene 34. The polystyrene is believed to form a transient liquid phase prior to vaporization. Because the melt temperature greatly exceeds the polystyrene decomposition temperature, it is believed that the polystyrene 34 liquifies and vaporizes significantly in advance of melt front 30 so that a space 50 is formed therebetween, which space is occupied by hot polystyrene decomposition vapors. Vapor buildup in space 50 pneumatically slows the advance of melt front 30, thereby slowing the rate at which melt 26 consumes and fills pattern 10. This reduces turbulence in melt 26 that would otherwise entrap vapors, and even unvaporized polystyrene, and thereby create pores in the casting. However, if the vapors are not eventually exhausted, they become engulfed by the constant advance of melt front 30.

The thermal insulation provided by refractory coat 32 delays the time required for heat from melt 26 to vaporize the acrylic polymer of overcoat 48. As can be seen in FIG. 3, it is believed that overcoat 48 vaporizes in advance of melt front 30, but significantly behind polystyrene 34. After overcoat 48 vaporizes, only refractory coat 32 remains, whose high permeability permits the vapors to readily escape into mold 18. This venting allows melt front 30, driven by hydrostatic pressure of melt in downsprue 14, to steadily advance without engulfing vapors, thereby reducing pores in the product casting. Thus, overcoat 48 progressively vaporizes in a manner substantially similar to the consumption of pattern 10, as illustrated by the partial coating remaining in FIG. 1.

Eventually, polystyrene 34 and overcoat 48 are completely vaporized and pattern 10 is replaced by melt 26, as illustrated in FIG. 4. Mold 18 probably collapses against the refractory coat 32, although this is not considered significant in view of the overcoat thinness and turbulence in mold 18 created by the voluminous venting vapors. Metal 26 cools and solidifies to form the casting. Residual coat 32 is readily cleaned off the casting using a pressurized water stream or other suitable technique. In addition to reducing metal porosity, dual coats 32 and 48 also produce an acceptable surface finish on the casting.

Although this invention has been described in terms of a particular refractory coat and vaporizable overcoat, it is apparent that other suitable materials may be substituted. For example, materials are marketed for forming consumable coatings on lost foam patterns, wherein the coating provides the desired thermal insulation and also vaporizes along with the adjacent polystyrene pattern. For example, a suitable consumable coating material is commercially available from the Thiem Company under the trade designation 125-260-1. When applied over a refractory coat, such consumable coatings are delayed from vaporization while providing initially low gas permeability, and are thus suitable for reducing casting porosity in accordance with this invention. Also, in the described embodiment for casting aluminum alloy, a principal purpose of the refractory coat is to prevent premature solidification. The dual coating is also suitable for lost foam casting of other metals, including iron. In casting iron, a thicker refractory coat or vaporizable coat may be desirable to restrain the mold from collapsing after pattern vaporization and before melt replacement.

Although this invention has been described in terms of certain embodiments thereof, it is not intended to be limited to the above description but rather only to the extent set forth in the claims that follow.

The embodiments of the invention in which an exclusive property or privilege is claimed are defined as follows:

1. A coated pattern for casting reduced porosity metal by a lost foam process comprising a fugitive pattern adapted to be substantially concurrently decomposed and duplicated by molten metal to form a casting, said decomposition forming vapors that produce pores in the casting when entrapped in the metal, and a coating applied to the pattern and comprising a thermally insulative material that is substantially stable at metal casting temperatures, and a material adapted to be substantially vaporized by heat from pattern-duplicating molten metal during casting and being arranged within the coating such that said insulative material thermally insulates said vaporizable material from the pattern and thereby is adapted to insulate the vaporizable material from pattern-duplicating molten metal during casting, said materials cooperating to initially retard gas flow through the coating but to readily vent pattern-derived vapors through the residual material after vaporization of said vaporizable material, said insulation within said coating being adapted to suitably delay vaporization to allow pattern-derived vapors to reduce turbulence in the molten metal, but thereafter allowing pattern-derived vapors to vent through the coating to avoid entrapment within the metal.

2. A multicoated pattern for casting reduced porosity metal by a lost foam process comprising a consumable pattern formed of a material vaporizable at metal casting temperatures and suitably sized and shaped for duplication by molten metal to form a casting, said pattern being adapted to be progressively vaporized and replaced by molten metal during casting, whereupon pattern decomposition vapors that are entrapped in the metal form pores in the casting, a refractory layer coating the pattern and adapted to thermally insulate pattern replacement molten metal during casting to prevent premature solidification, said layer being characterized alone by a relatively high permeability to pattern decomposition vapors, and a vaporizable layer generally overlying the refractory layer in thermal insulative relationship to the pattern so as to be insulated from pattern-replacement molten metal during casting, said overlayer being formed of a material vaporizable at metal casting temperatures and cooperating with the refractory layer to produce a relatively low permeability to pattern decomposition vapors, whereby during casting thermal insulation provided by the refractory layer delays overlayer vaporization and the low vapor permeability of the combined layers causes vapors to build up and slow metal replacement of the pattern to reduce vapor entrapping turbulence in the metal, said overlayer thereafter vaporizing to allow vapors to vent through the relatively permeable refractory layer to thereby complete pattern replacement while avoiding vapor entrapment.

3. A dual coated pattern for casting reduced porosity metal by a lost foam process comprising a low density polystyrene pattern suitably sized and shaped for duplication by metal to form a desired casting, said pattern being adapted to be embedded in a suitable loose sand mold such that an embedded surface thereof faces the mold and to be progressively vaporized and replaced by molten metal during casting, whereupon polystyrene decomposition vapors require venting into the mold to avoid entrapment in the metal that forms pores in the casting, a refractory coat applied onto the embedded pattern surface and adapted to thermally insulate molten metal during casting to prevent premature solidification, said coat being formed of bonded refractory particles and comprising pores and cracks suitable for conveying gases through the coat, and a polymeric coat applied generally over the insulative coat and filling cracks therein, said polymeric coat being formed of a polymer vaporizable at metal casting temperatures and suitably dense and nonporous so as to be relatively impermeable to gas, said polymeric coat being thermally insulated from the pattern by the refractory coat to delay vaporization of the polymeric coat during casting such that the polystyrene decomposition vapors build up as a result of the gas impermeability of the polymeric layer and slow pattern replacement to reduce vapor-entrapping turbulence in the metal, said polymeric coat being adapted to thereafter vaporize to vent polystyrene decomposition vapors through the pores and the cracks in the refractory coat to avoid entrapment in the metal.

4. A metal casting process adapted to duplicate a fugitive pattern in reduced porosity metal, said process comprising forming a pattern vaporizable at metal casting temperatures, said pattern being suitably sized and shaped for duplication by metal to form a casting, applying to the pattern a coating comprising a refractory material and a material vaporizable at metal casting temperatures, said materials cooperating to form a relatively gas-impermeable coating, but to form a relatively gas-permeable residual coating upon vaporization of said vaporizable material, said materials being arranged within the coating such that said refractory material is adapted to thermally insulate the vaporizable material from metal during casting, surrounding the coated pattern with a suitable mold material, casting molten metal onto the pattern within the mold to vaporize and to duplicate the pattern with molten metal to form the casting, and vaporizing the vaporizable coating material during said casting to produce a gas-permeable residual coating, said insulation provided by the refractory material suitably delaying vaporization to allow pattern-derived vapors to reduce turbulence in the molten metal as the metal duplicates the pattern, but thereafter allowing the vapors to vent through the coating into the mold to avoid entrapment within the metal.

5. A lost foam process for casting reduced porosity metal comprising forming a pattern of a material that decomposes at metal casting temperatures to form vapors, said pattern being adapted to be suitably replaced by molten metal to form a casting, coating the pattern with a first layer of a refractory material adapted to thermally insulate pattern-replacement molten metal during casting to prevent premature solidification, said layer being characterized by a relatively high permeability to pattern decomposition vapors, coating the pattern with a second layer of a material vaporizable at metal casting temperatures such that the second layer generally overlies and is insulated from the pattern by the first refractory layer, said layer cooperating with the refractory layer to produce a relatively low permeability to pattern decomposition vapors through the combined layers, surrounding the coated pattern with a suitable mold material, contacting the pattern in the mold with molten metal such that the metal decomposes the pattern material and thereafter flows to replace the pattern to form the casting, whereupon pattern decomposition forms vapors that produce pores in the casting if entrapped in the metal, and vaporizing the second coating layer by heat from the molten metal during pattern replacement, said vaporization being delayed by thermal insulation provided by the first layer for a time suitable to cause vapors to build up and slow pattern replacement by the metal to reduce gas-entrapping turbulence, said vaporization leaving behind the high permeability refractory material wherethrough the vapors readily vent to avoid entrapment in the metal.

6. A lost foam process for casting reduced porosity metal comprising forming a low density polystyrene pattern suitably sized and shaped to form a desired casting and adapted to be progressively vaporized and replaced by molten metal during casting, whereupon polystyrene decomposition vapors that become entrapped in the metal form pores in the casting, transiently dipping the pattern into an aqueous slurry comprising refractory particles and a suitable bonding agent to apply a layer of slurry material onto a surface of the pattern, drying the slurry layer on the pattern to bond said refractory particles to form a first coat comprising interstitial pores and cracks suitable for conveying gas through the coat, transiently dipping the refractory coated pattern into an aqueous emulsion comprising a polymeric material vaporizable at metal casting temperatures, said dipping applying a layer of emulsion onto the coated pattern surface, drying the emulsion layer to form a second coat of dense polymer over said refractory coat, said polymer coat being relatively impermeable to gas, embedding the dual coated pattern in a mold formed of unbonded sand such that said coated surface is adjacent the sand, contacting the embedded pattern with molten metal to progressively decompose the polystyrene and to replace the pattern with the metal to form the casting, and vaporizing the polymer coat by heat from the molten metal during pattern replacement, said vaporization being delayed by thermal insulation provided by the refractory coat, whereupon the relative gas impermeability of the polymeric coat causes polystyrene decomposition vapors to build up and slow pattern replacement by the metal to reduce turbulence therein, said polymeric coat vaporization leaving behind said refractory coat and allowing polystyrene decomposition vapors to vent through pores and cracks therein into the sand mold, said reduced metal turbulence and said sand mold venting reducing vapor entrapment in the metal and thereby porosity in the casting.

* * * * *